US012473619B2

(12) United States Patent
Underys et al.

(10) Patent No.: US 12,473,619 B2
(45) Date of Patent: Nov. 18, 2025

(54) LOW PHOSPHORUS, ZIRCONIUM MICRO-ALLOYED, FRACTURE RESISTANT STEEL ALLOYS

(71) Applicant: A. Finkl & Sons Co., Chicago, IL (US)

(72) Inventors: Algirdas Underys, Arlington Heights, IL (US); Benjamin Ritchey, Chicago, IL (US); Jesse Adamson, Chicago, IL (US)

(73) Assignee: A. Finkl & Sons Co., Chicago, IL (US)

( * ) Notice: Subject to any disclaimer, the term of this patent is extended or adjusted under 35 U.S.C. 154(b) by 156 days.

(21) Appl. No.: 16/706,320

(22) Filed: Dec. 6, 2019

(65) Prior Publication Data

US 2020/0190641 A1 Jun. 18, 2020

Related U.S. Application Data

(60) Provisional application No. 62/777,464, filed on Dec. 10, 2018.

(51) Int. Cl.

| | |
|---|---|
| ***C22C 38/02*** | (2006.01) |
| ***C21D 8/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/18*** | (2006.01) |

(52) U.S. Cl.

CPC ..... *C22C 38/08* (2013.01); *C21D 8/021* (2013.01); *C22C 38/02* (2013.01); *C22C 38/04* (2013.01); *C22C 38/06* (2013.01); *C22C 38/10* (2013.01); *C22C 38/12* (2013.01); *C22C 38/14* (2013.01); *C22C 38/18* (2013.01)

(58) Field of Classification Search

CPC ..... C22C 38/02; C22C 38/04; C22C 38/44; C22C 38/50; C22C 38/06; C22C 38/40

See application file for complete search history.

(56) References Cited

U.S. PATENT DOCUMENTS

2008/0226491 A1* 9/2008 Satou ..... B23K 11/16 219/78.01
2020/0248290 A1* 8/2020 Takayama ..... C22C 38/02

FOREIGN PATENT DOCUMENTS

JP 2000219936 A * 8/2000
WO WO-2018168248 A1 * 9/2018 ..... C21D 1/25

OTHER PUBLICATIONS

English translation of JP2000219936 by EPO, Jul. 17, 2021. (Year: 2021).*
English Translation of Nakamura et al., JP2000219936A, obtained form EPO espacenet on Feb. 21, 2024 (Year: 2024).*

* cited by examiner

*Primary Examiner* — Adam Krupicka
(74) *Attorney, Agent, or Firm* — von Briesen & Roper, s.c.

(57) ABSTRACT

A steel alloy composition is disclosed. The steel alloy composition may comprise 0.36% to 0.60% by weight carbon, 0.30% to 0.70% by weight manganese, between 0.001% to 0.017% by weight phosphorus, 0.15% to 0.60% by weight silicon, and 1.40% to 2.25% by weight nickel. The steel alloy composition may further comprise 0.85% to 1.60% by weight chromium, 0.70% to 1.10% by weight molybdenum, 0.010% to 0.030% by weight aluminum, 0.001% to 0.050% by weight zirconium, and a balance of iron.

14 Claims, 6 Drawing Sheets

LOW PHOSPHORUS, ZIRCONIUM MICRO-ALLOYED, FRACTURE RESISTANT STEEL ALLOYS

TECHNICAL FIELD

This disclosure generally relates to steel alloys and, more particularly, to steel alloy compositions having low phosphorus, containing zirconium additions, and to articles fabricated therefrom.

BACKGROUND

Numerous industries, such as the closed die forging industry, tooling industries, and hydraulic fracking industries rely on parts that are suited for rugged demands in practice. To meet such rugged demands, it is desirable to fabricate such parts from a material that exhibits properties such as high fatigue resistance, high fracture resistance, high strength, high hardness, high wear resistance, excellent through hardness, elevated temperature stability, and good machinability, among others. The present application is directed to novel steel alloy compositions that exhibit such properties.

SUMMARY

In accordance with one aspect of the present disclosure, a steel alloy composition is disclosed. The steel alloy composition may comprise 0.36% to 0.60% by weight carbon, 0.30% to 0.70% by weight manganese, 0.001% to 0.017% by weight phosphorus, 0.15% to 0.60% by weight silicon, and 1.40% to 2.25% by weight nickel. The steel alloy composition may further comprise 0.85% to 1.60% by weight chromium, 0.70% to 1.10% by weight molybdenum, 0.010% to 0.030% by weight aluminum, 0.001% to 0.050% by weight zirconium, and a balance of iron.

In accordance with another aspect of the present disclosure, a steel alloy composition for an article having a cross-sectional thickness of 20 inches or more is disclosed. The steel alloy composition may comprise 0.36% to 0.46% by weight carbon, 0.30% to 0.50% by weight manganese, 0.001% to 0.012% by weight phosphorus, 0.15% to 0.30% by weight silicon, and 1.75% to 2.25% by weight nickel. The steel alloy composition may further comprise 1.40% to 1.60% by weight chromium, 0.90% to 1.10% by weight molybdenum, 0.015% to 0.025% by weight aluminum, 0.001% to 0.050% by weight zirconium, and a balance of iron.

In accordance with another aspect of the present disclosure, a steel alloy composition for an article having a cross-sectional thickness of 20 inches or less is disclosed. The steel alloy composition may comprise 0.50% to 0.60% by weight carbon, 0.50% to 0.70% by weight manganese, 0.001% to 0.017% by weight phosphorus, 0.40% to 0.60% by weight silicon, and 1.40% to 1.75% by weight nickel. The steel alloy composition may further comprise 0.85% to 1.15% by weight chromium, 0.70% to 0.90% by weight molybdenum, 0.010% to 0.030% by weight aluminum, 0.001% to 0.050% by weight zirconium, and a balance of iron.

These and other aspects and features of the present disclosure will be more readily understood when read in conjunction with the accompanying drawings.

DETAILED DESCRIPTION OF THE DISCLOSURE

Various aspects of the disclosure will now be described with reference to the drawings and tables disclosed herein. The invention consists of steel alloy compositions (and articles formed therefrom) that include an aluminum deoxidized steel having a zirconium nitride or zirconium carbonitride pinned austenitic grain structure suitable for elevated and room temperature operating conditions. The articles fabricated from the steel alloy compositions disclosed herein exhibit high fatigue resistance, high fracture resistance, a fine grain derived from close control of the deoxidizing elements aluminum and zirconium, and, also close control of phosphorus. The steel alloy compositions disclosed herein are adaptable to the rugged demands of the closed die forging industry, and the different yet equally demanding requirements of the machine parts industry, said steel alloy compositions requiring only modest amounts of alloying constituents; i.e.: less than 7.25%, and being therefore economical to produce by the manufacturer and easy to use by the consumer. The aluminum deoxidized steel alloy compositions and the components made therefrom, in addition to having excellent fatigue resistance and fracture resistance properties, also have high strength, high hardness, high wear resistance, excellent through hardness, good machinability and, especially, prior austenite grain boundaries which are pinned with zirconium nitrides and zirconium carbonitrides.

Figure 1:
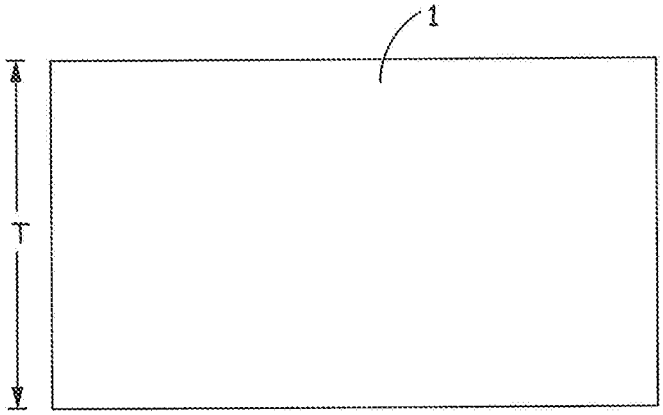
FIG. 1 is an article fabricated from a steel alloy composition disclosed herein.

Referring to FIG. 1, an article 1 fabricated from a steel alloy composition of the present disclosure is shown. The article 1 may have a cross-sectional thickness (T). As non-limiting examples, the article 1 may be a die block, a machine part, a tool, or a pump block including its internal components. As such, it will be understood that the article 1 may have various shapes and sizes in practice depending on its intended application.

Tables 1-4 below list exemplary steel alloy compositions for fabricating the article 1. Composition A has a broader range of elements, and composition D has a lower phosphorus content. Composition B is suitable for the fabrication of articles having a cross-sectional thickness (T) of 20 inches or less, and composition C is suitable for the fabrication of articles having a cross-sectional thickness (T) of 20 inches or more.

TABLE 1

| Composition A (Broad) | | |
|---|---|---|
| Element | Min (% by weight) | Max (% by weight) |
| C | 0.36 | 0.60 |
| Mn | 0.30 | 0.70 |
| P | 0.001 | 0.017 |
| S | | 0.025 |
| Si | 0.15 | 0.60 |
| Ni | 1.40 | 2.25 |
| Cr | 0.85 | 1.60 |
| Mo | 0.70 | 1.10 |
| V | 0.02 | 0.10 |
| Cu | | 0.35 |
| Al | 0.010 | 0.030 |
| Ti | | 0.020 |
| Zr | 0.001 | 0.050 |
| Fe (balance) | | |

TABLE 2

| Composition B (Cross-sectional thickness (T) 20" or less) | | |
|---|---|---|
| Element | Min (% by weight) | Max (% by weight) |
| C | 0.50 | 0.60 |
| Mn | 0.50 | 0.70 |
| P | 0.001 | 0.017 |
| S | | 0.025 |
| Si | 0.40 | 0.60 |
| Ni | 1.40 | 1.75 |
| Cr | 0.85 | 1.15 |
| Mo | 0.70 | 0.90 |
| V | 0.02 | 0.10 |
| Cu | | 0.35 |
| Al | 0.010 | 0.030 |
| Ti | | 0.020 |
| Zr | 0.001 | 0.050 |
| Fe (balance) | | |

TABLE 3

| Composition C (Cross-sectional thickness (T) 20" or more) | | |
|---|---|---|
| Element | Min (% by weight) | Max (% by weight) |
| C | 0.36 | 0.46 |
| Mn | 0.30 | 0.50 |
| P | 0.001 | 0.012 |
| S | | 0.003 |
| Si | 0.15 | 0.30 |
| Ni | 1.75 | 2.25 |
| Cr | 1.40 | 1.60 |
| Mo | 0.90 | 1.10 |
| V | 0.02 | 0.07 |
| Cu | | 0.35 |
| Al | 0.015 | 0.025 |
| Ti | | 0.020 |
| Zr | 0.001 | 0.050 |
| Fe (balance) | | |

TABLE 4

| Composition D (Lower Phosphorus) | | |
|---|---|---|
| Element | Min (% by weight) | Max (% by weight) |
| C | 0.36 | 0.60 |
| Mn | 0.30 | 0.70 |
| P | 0.001 | 0.005 |
| S | | 0.025 |
| Si | 0.15 | 0.60 |
| Ni | 1.40 | 2.25 |

TABLE 4-continued

| Composition D (Lower Phosphorus) | | |
|---|---|---|
| Element | Min (% by weight) | Max (% by weight) |
| Cr | 0.85 | 1.60 |
| Mo | 0.70 | 1.10 |
| V | 0.02 | 0.10 |
| Cu | | 0.35 |
| Al | 0.010 | 0.030 |
| Ti | | 0.020 |
| Zr | 0.001 | 0.050 |
| Fe (balance) | | |

Carbon, in increasing amounts, lowers the temperature that transformation to martensite begins. However, as the temperature is lowered, an increased amount of less desirable transformation products, such bainite and pearlite, are formed. From the broad perspective of the objectives to be attained however carbon, a potent alloy, should be lowered to improve ductility, and hence carbon should be present in the range of 0.36-0.60. Carbon tends to segregate and concentrate to the center of an ingot, and this tendency increases as the size of the ingot increases. Larger ingots are typically required for greater thickness product, so carbon in the range of 0.50-0.60 for thicknesses less than 20" is tolerated but must be decreased for thicker cross-sections. Decreasing the carbon content has a disadvantageous effect however in that carbon is essential to provide the necessary strength and hardness for hot working application of the steel in closed die forging. Carbon also greatly influences the hardenability, that is, how deeply hardness will penetrate a given cross-section. Therefore, lowered carbon must somehow be compensated for if satisfactory performance in closed die forging applications is to be maintained while at the same time providing a product having high room temperature ductility which is essential for machine part applications. If such compensation can be achieved, carbon in the range of 0.36-0.46 can be tolerated for product with thickness greater than 20 inches.

Manganese, a mild deoxidizer, should be present in the range of 0.30-0.70. Decreasing manganese below the indicated level will increase the possibility of red shortness caused by sulfur. Also, decreasing manganese will detract from the hardenability of the steel. Increasing the manganese content above the indicated level will lower the transformation temperature of martensite, thereby decreasing ductility. Manganese is also prone to segregation in large ingots. The range of 0.50 to 0.70 is preferred for thicknesses less than 20". If the loss of hardenability can be compensated for, decreasing the manganese to 0.30 to 0.50 is preferred for thickness of product greater than 20".

Phosphorus is an important element whose contribution to the desired properties has not heretofore been fully appreciated. Phosphorus is of particular importance with respect to the endurance limit and fracture toughness of the steel. Phosphorus segregates during austenitizing heat treatments and appears to stimulate the formation of cementite, and thus the precipitation of carbon to the grain boundaries during quenching. Further, the degree of phosphorus segregation is dependent on the phosphorus and carbon content of the steel. When too much phosphorus segregation, and accompanying carbon precipitation occurs, a point is reached at which fatigue resistance and fracture resistance are so seriously affected that the steel's usefulness as a dual purpose closed die forging implement or a machine part is compromised to an unacceptable extent. In tests on a similar low alloy steel and specifically a slightly modified 4320 steel which differed solely in the phosphorus content, the results shown in FIG. 1 were obtained on specimens having 0.005, 0.017 and 0.031 phosphorus respectively. The curves show that endurance limits decreased with an increase in phosphorus content and, further, that the fatigue life was quite similar in the 0.005 and 0.017 specimens, but significantly lower in the 0.031 specimens.

Figure 2:
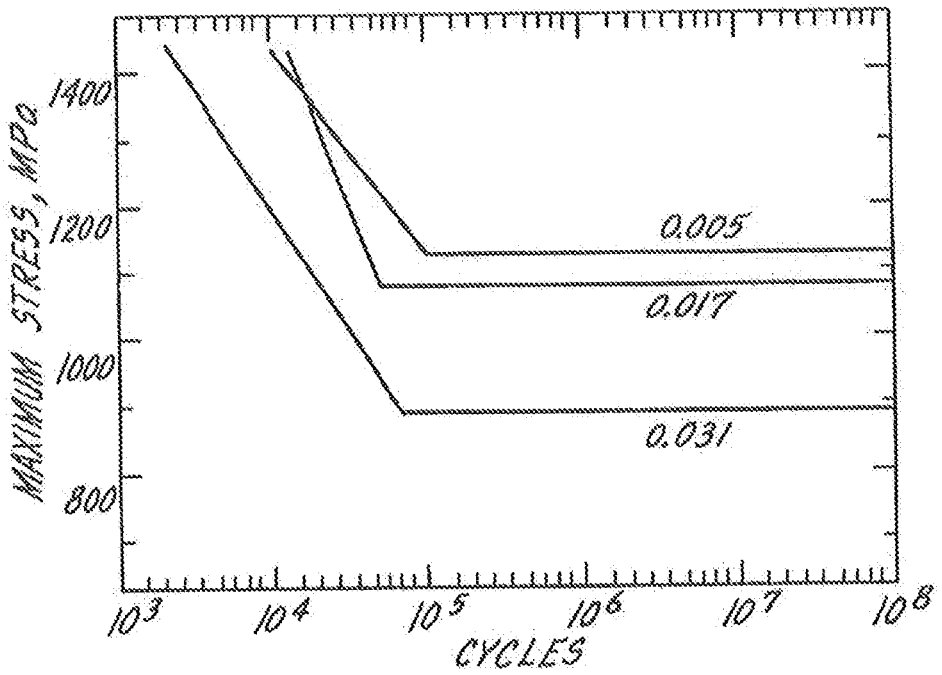
FIG. 2 is a comparison of maximum stress v. number of cycles for steels containing 0.005, 0.017, and 0.031 weight percent phosphorus, respectively.
Figure 3:
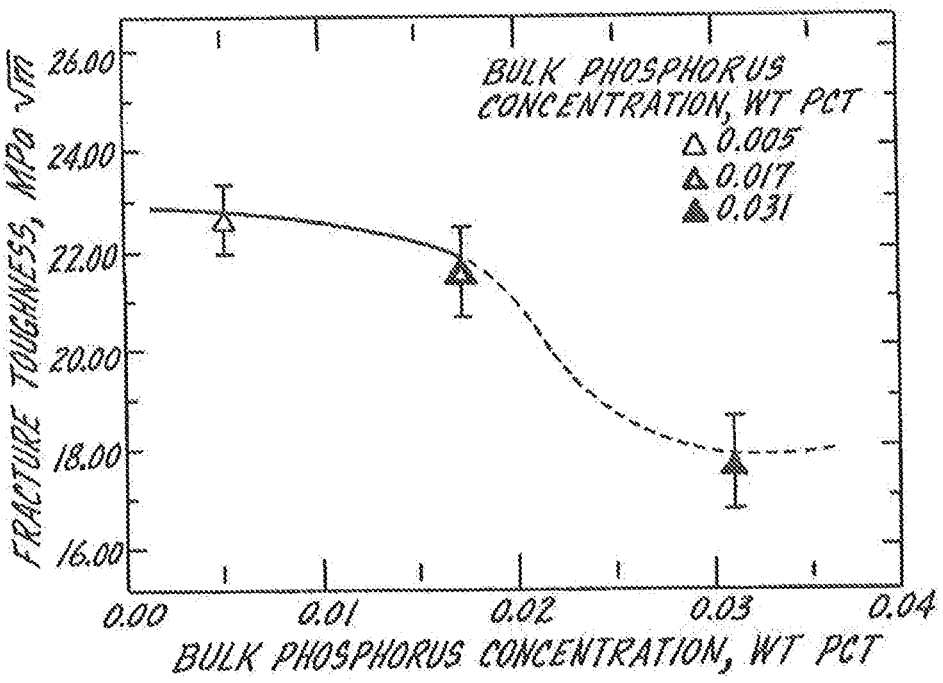
FIG. 3 is a plot of average fracture toughness as a function of bulk phosphorus content in said three steels.

In fracture toughness tests on specimens of said three variations the results shown in FIG. 2 were obtained which clearly indicate that phosphorus lowers the fracture resistance. Again, the 0.005 and 0.017 phosphorus steels have similar toughness characteristics, with the 0.005 phosphorus steel being somewhat better, but with the 0.031 phosphorus steel being considerably lower.

It should be noted that phosphorus also has a major effect on the microstructure and properties of such alloy steel. Table 5 below shows that there is a strong affinity of phosphorus and carbon to co-segregate to austenite grain boundaries as indicated by a simultaneous increase of intergranular phosphorus and carbon with increasing bulk phosphorus concentrations.

TABLE 5

| P (Wt Pct) | Percent Retained Austenite (25 μm) | Endurance Limit (MPa) | Average Fracture Toughness (MPa ✓m) | Intergranular Phosphorus Concentration (25 μm) | Intergranular Carbon Concentration (25 μm) |
|---|---|---|---|---|---|
| 0.005 | 29.8 | 1125 | 23 | 0.7 at. pct | 20.6 at. pct |
| 0.017 | 25.3 | 1075 | 22 | 0.9 at. pct | 21.4 at. pct |
| 0.031 | 18.7 | 875 | 18 | 1.6 at. pct | 23.7 at. pct |

It will be noted that the stronger said interaction, the lower are the fatigue and fracture resistance, again with little difference between the 0.005 phosphorus and the 0.017 phosphorus, with the 0.005 phosphorus being somewhat better, but with a significant difference between the 0.005/0.017 phosphorus on the one hand and the 0.031 phosphorus on the other hand.

It should be noted that with increasing phosphorus content, the solubility of carbon in austenite decreases, and therefore, as the steel's phosphorus content increases and concentrations of phosphorus build up at the austenite grain boundaries, the formation of cementite is enhanced and the solubility of carbon in equilibrium with the cementite decreases. As a consequence, the more complete the coverage of the grain boundaries by the cementite, the lower the fatigue and fracture resistance.

From the foregoing it can be seen that increasing the steel's phosphorus content causes increased segregation of phosphorous and carbon at the grain boundaries with the carbon in the form of intergranular cementite. Further, with increasing phosphorus comes lower fatigue and lower fracture resistance, two properties which must be at a high level for closed die forging and machine part applications. In terms of magnitude, the fatigue resistance and fracture resistance of steels decreases slightly from 0.005 phosphorus to 0.017 phosphorus but decreases sharply in steel containing 0.031 phosphorus.

It will be appreciated, however, that although a final phosphorus content of 0.005 is attainable on small melts, this low level is very difficult to achieve at the present time in high volume electric furnace steelmaking. However, control of phosphorus has consistently improved over the past few years to the point where phosphorus values of 0.012 can be consistently achieved in large tonnage production, and further work toward attainment of lower phosphorus levels continues. Thus, although 0.005 is an ideal toward which research efforts are directed, 0.012 represents a realistic achievable level for the efficient, technically progressive, large tonnage electric furnace steelmaker at the present time.

Lower sulfur levels would improve the ductility of the steel. Sulfur, however, is required to maintain the easy machinability of the steel. A small but effective quantity of sulfur must be present, but the upper sulfur level preferably should be maintained below 0.025% maximum. Sulfur also has a tendency to segregate to the center of large ingots. Sulfur in product with thicknesses greater than 20" should be limited to a maximum of 0.003%.

Silicon should be maintained in the range of 0.15 to 0.60. Silicon is an important element in this composition due to its deoxidation capability. Silicon also has a tendency to segregate to the center of large ingots. Silicon in product with thicknesses greater than 20" should be limited to a range of 0.15 to 0.30. Zirconium has a high affinity for oxygen and can be used to deoxidize a melt through the formation of zirconium oxides. These zirconium oxides, however, act as inclusions that are detrimental to the physical properties. The melt must be thoroughly deoxidized before any zirconium is added to achieve the maximum benefit of the zirconium. A minimum level of silicon of 0.15 assures that the melt is deoxidized before any additions of zirconium can be made, and hence silicon must not be reduced below this level. Increased levels of silicon in amounts greater than the range specified can affect the solidification behavior of the steel, possibly resulting in ingot flaws such as primary and secondary pipe.

Nickel should be maintained in the range of 1.40 to 2.00% for its contribution to toughness, hardenability, and improved resistance to heat checking. At low temperatures, a material may exhibit a brittle mode of failure under impact forces. At elevated temperatures, this same material will exhibit a ductile mode of failure under impact forces. This temperature at which the material changes from being brittle to being ductile is called the fracture appearance transition temperature (FATT). Die steels should be preheated above the FATT temperature in order to avoid brittle failure under impact loads. If the FATT curve can be shifted to lower temperatures, the brittle failures due to inadequate preheating can be minimized. Nickel is used for its ability to shift the fracture transition temperature i.e., the transition from brittle to ductile mode. A minimum nickel concentration of 1.40 percent is necessary to avoid catastrophic die breakage due to inadequate preheating.

Figure 4:
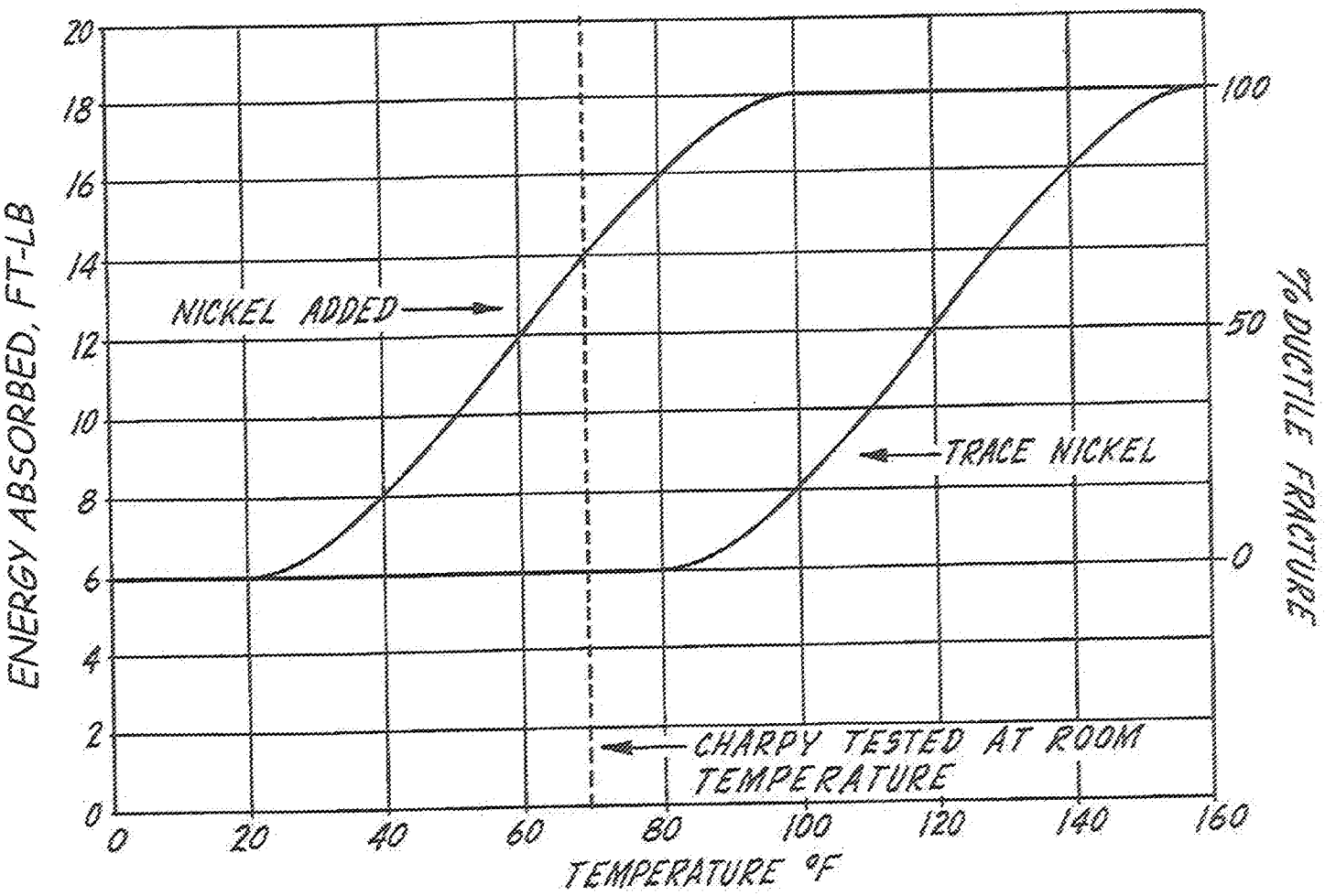
FIG. 4 is a concept curve illustrating the shift in the fracture appearance transition temperature (FATT) curve when a small but effective amount of Ni is added as contrasted with the absence of Ni or only trace Ni.

FIG. 4 dramatically illustrates the shift of the FATT curve for a generic die steel as represented by (a) the trace nickel curve on the right side of the graph of FIG. 4 which shows that a pre-heat temperature of at least 130° F. is required, and (b) the nickel added curve on the left side of FIG. 4 which shows that no pre-heat, or only room temperature is required to produce the same impact resistance. Increased nickel concentrations, however, increase the amount of retained austenite in steel. If the retained austenite decomposes to untempered martensite in a die steel during use as a forging die, a hard, brittle phase may develop that can lead to catastrophic die failure. Nickel is also one of the most costly alloys and should therefore be limited to the above range in order to make the steel, and fabricated parts made therefrom, price competitive.

Chromium is increased by an amount which is significant in these specialized applications and should be present in the range of 0.85-1.60. The preferred range for product thicknesses less than 20" is 0.85 to 1.15. However, if the carbon was lowered to help minimize segregation in large ingots, chromium should be increased to the range of 1.40 to 1.60 to help compensate for the loss of hardenability with the carbon decrease. It is also believed that the additional amount of chromium increases the wear resistance of the material through the increased formation of chromium carbides.

Molybdenum should be present in the range of 0.70-1.10. Molybdenum increases the hardenability of the steel while reducing the possibility of temper embrittlement. Molybdenum is a strong carbide former that improves wear resistance. It is however a relatively expensive alloy and, assuming conformance to the other ranges herein described and conventional heat treatment, molybdenum in the range of 0.70-0.90 will provide satisfactory results for product thicknesses less than 20". To help offset the decrease in hardenability with the lower desired ranges of carbon, manganese, and silicon in part thicknesses greater than 20", a molybdenum range of 0.90 to 1.10 is preferred.

Vanadium must be present in a small but effective amount up to 0.10, but preferably in the range of 0.02-0.10%. Vanadium has three major effects. Vanadium is an important element for its effect on increasing hardenability. Vanadium also increases the wear resistance through the formation of vanadium carbides. Vanadium also is used to promote fine grain size through the same mechanism of prior austenite grain pinning as does zirconium. However, excessive quantities of vanadium are detrimental to the ductility through the formation of an increased quantity of coarse carbides, and hence it is best to keep the vanadium at a maximum of 0.10 for thicknesses less than 20" and at a maximum of 0.07 for thicknesses greater than 20".

Aluminum and zirconium must be considered together and, further, as will be apparent hereinafter, zirconium must, in turn, be considered in light of the quantity of nitrogen present in this type of steel. In other words, there is a definite relationship between aluminum, zirconium and nitrogen, and this relationship is a key factor in the desirable attributes of the fabricated parts and composition of this invention.

Aluminum is the deoxidizer of choice for producing a fine grain structure in this type of Cr—Ni—Mo low alloy steel. The use of too much aluminum can however result in excessive inclusions and hence aluminum must be present in a small but effective amount up to 0.030. However, to ensure a fine grain structure at moderate operating temperatures and, equally importantly, considering the presence of zirconium, the preferred range of aluminum is 0.015-0.025.

Zirconium is also a deoxidizer. However, zirconium has the unique characteristic that when it is added as an alloying element to an aluminum deoxidized steel enhances grain pinning through the formation of zirconium nitrides and zirconium carbonitrides. Thus, in closed die forging operations, it is essential that a combination of aluminum and zirconium be present to ensure that a fine grain structure is obtained. The amount of zirconium which should be present has been found, in turn, to be dependent on the amount of nitrogen present, as will be apparent from the following.

Zirconium forms nitrides, carbides, and carbo-nitrides, all of said compounds being to some degree stable at elevated operating temperatures of, for example, approximately 2150.degree. F. Of these compounds, zirconium nitrides are especially suitable for pinning austenite grain boundaries. The stoichiometric ratio of zirconium to nitrogen is 6.5 to 1 in weight percent. Assuming a typical range of nitrogen in the subject steel of 40 to 90 ppm, the maximum zirconium to achieve a stoichiometric composition with nitrogen would be 0.058 weight percent. Studies have shown that hypostoichiometric compositions are more effective in grain pinning and therefore, a maximum zirconium level of 0.05 weight percent would be desirable. With respect to a minimum zirconium level, a forging die steel with a similar composition, obtained beneficial results in ductility at a zirconium level of 0.002 weight percent. Therefore, the desired range of zirconium should be between 0.001 and 0.050 weight percent.

INDUSTRIAL APPLICABILITY

In general, the teachings of the present disclosure may find applicability in many industries including, but not limited to, die forging, pump manufacturing, and machine part or tool manufacturing industries. More specifically, the present disclosure may be applicable to any industry requiring robust steel parts for demanding applications with high fatigue resistance, high fracture resistance, high strength, high hardness, high wear resistance, excellent through hardness, good machinability, and high temperature resistance.

Figure 5:
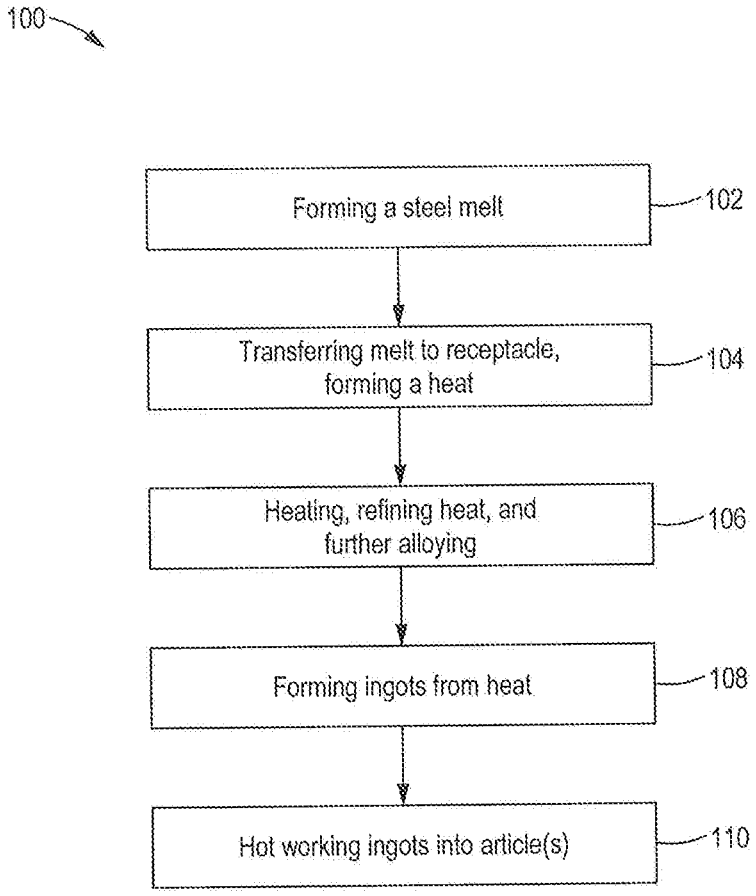
FIG. 5 is a method of manufacturing an article from a steel alloy composition of the present disclosure.
Figure 6:
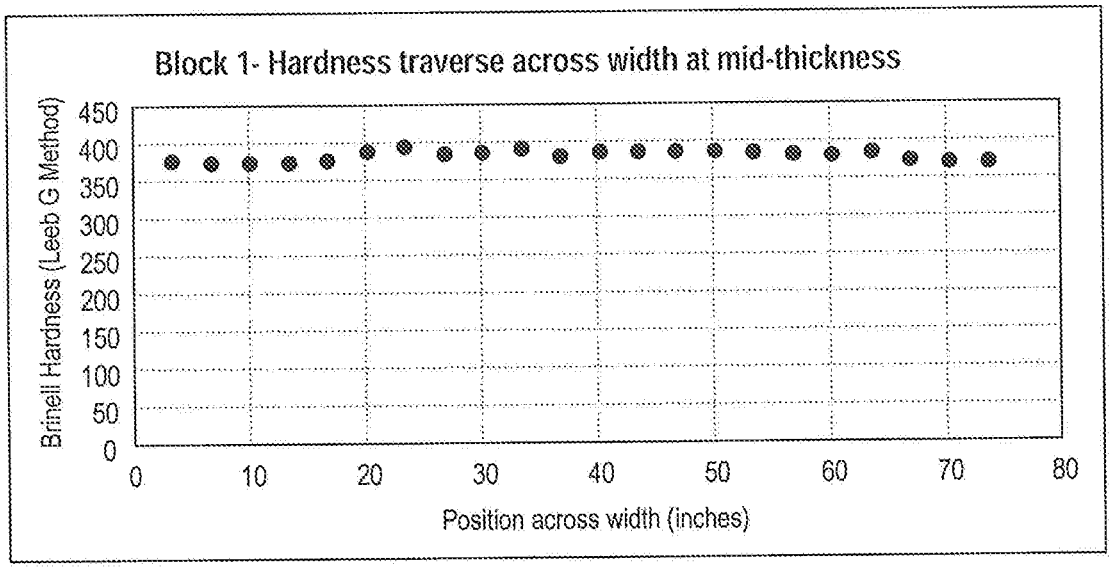
FIG. 6 is a data plot showing the hardness of Block 1 at positions across the width of Block 1 at mid-thickness, in accordance with the present disclosure.
Figure 7:
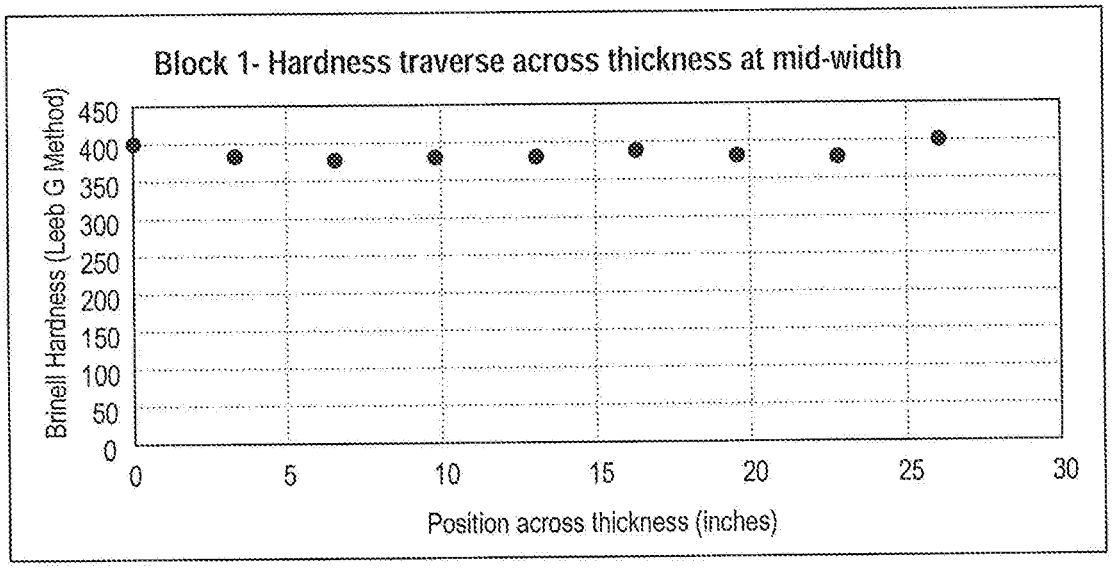
FIG. 7 is a data plot showing the hardness of Block 1 at positions across the thickness of Block 1 at mid-width, in accordance with the present disclosure.
Figure 8:
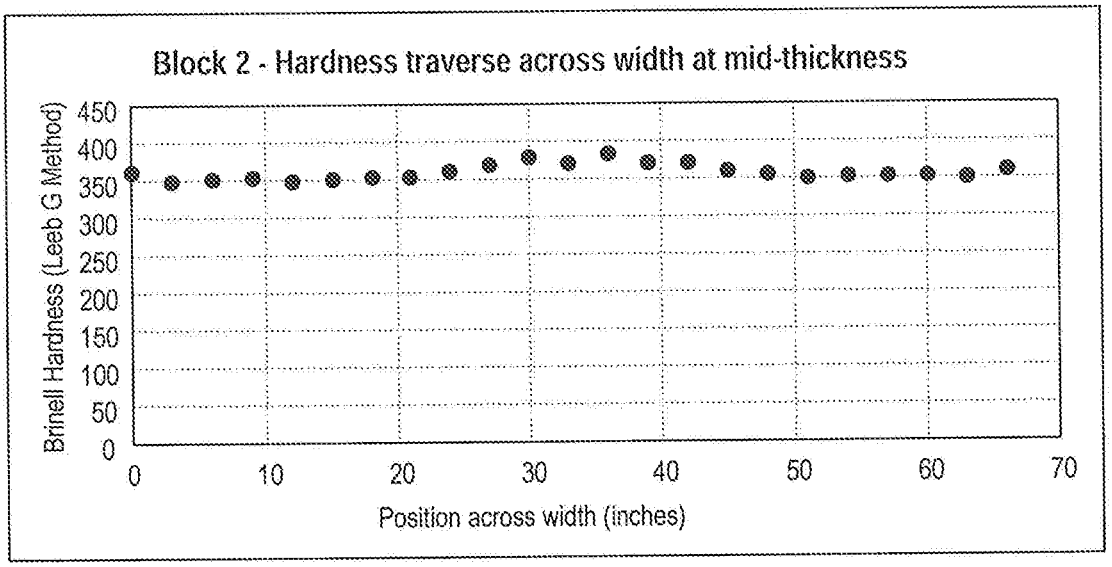
FIG. 8 is a data plot showing the hardness of Block 2 at positions across the width of Block 2 at mid-thickness, in accordance with the present disclosure.
Figure 9:
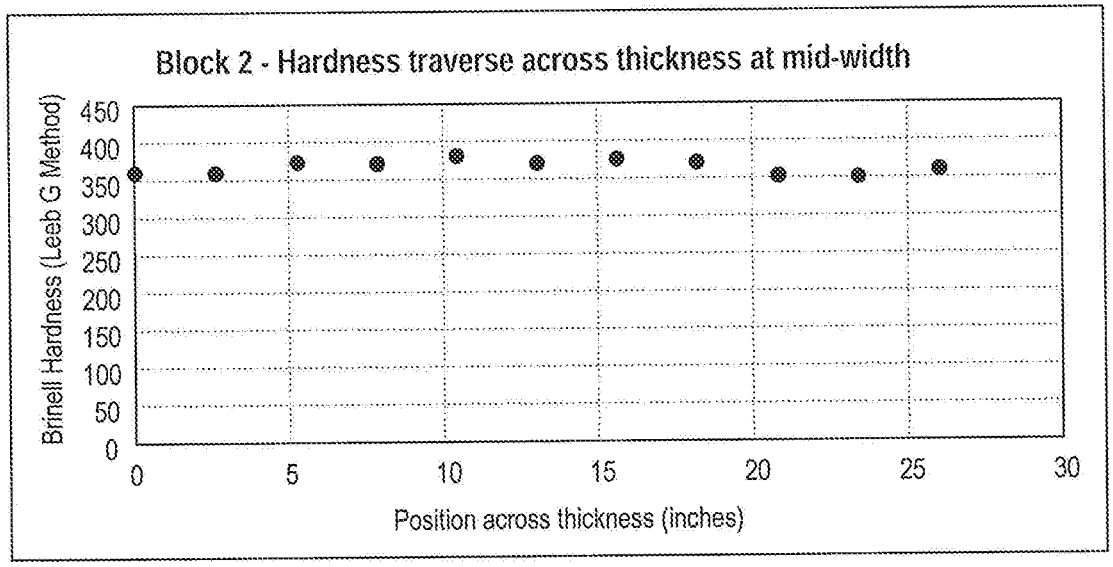
FIG. 9 is a data plot showing the hardness of Block 2 at positions across the thickness of Block 2 at mid width, in accordance with the present disclosure.

FIG. 5 shows a series of steps that may be involved in manufacturing the article 1. For example, the resulting article may be able to meet the rugged demands of the closed die forging process as well as the equally demanding requirements of the machine parts industry. The method 100 may include the steps of: (1) forming a steel melt in a heating unit having less than all of the alloy ingredients (block 102), (2) transferring said melt to a receptacle to thereby form a heat (block 104), (3) heating, refining said heat with argon purging, and further alloying of the alloy composition into specification (block 106), (4) vacuum degassing, teeming and casting said heat to form ingots by bottom pouring (block 108), and (5) hot working said ingots to form said steel alloy into the article(s) 1 (block 110).

As evidence of the efficacy of the present disclosure, physical property data has been collected from fourteen heats of the subject chemistry. One large ingot was cast from each heat. The ingot sizes that were used were 92" diameter (90 ton), 100" diameter (100 ton), and 108" diameter (140 ton) round fluted ingots. The size of the blocks forged from the ingots ranged from the smallest block with the dimensions of 20"×77"×188" (83,636 lb) to the largest block with dimensions of 30"×86"×200" (128,235 lb). The forged blocks were all heat treated to a surface hardness range of 363-415 HBW. The heat treatment for all blocks has consisted of four primary steps: 1: Austenitize and air cool, 2: Austenitize and water quench, 3: First Temper, 4: Second Temper.

The steel has demonstrated excellent impact strength and exhibited a high degree of uniformity in hardness and chemical composition throughout these large cross sections.

Room temperature (70° F.) impact strength in the transverse orientation (transverse impact strength) has been measured by the Charpy V-notch method (ASTM E23) on all fourteen blocks. Six individual Charpy bars were tested on each block. All tests were located 1" below the surface. The average transverse impact strength for all fourteen blocks is 24 ft-lb.

Two blocks were sectioned to test hardness uniformity across the block thickness and width (cross-sectional hardness uniformity or hardenability). The core hardness measurements for this study were made by the Leeb method (ASTM A956) and found the following:

Block 1

Finish Dimensions: 26"×77"×188"

Surface Hardness: 401-415 HBW

The test plane was a transverse section 40" in from the end of the block.

Block 2:

Finish Dimensions: 26"×67"×188"

Surface Hardness: 363-375 HBW

The test plane was a transverse section 20" in from the end of the block.

The chemistry variability directly affects the variability of the depth of hardness (hardenability) of a block. Two blocks were sectioned to test uniformity of chemical composition across the block thickness and width. The block dimensions were 26"×77"×188" and 26"×67"×188". The chemistry tests showed very little variation from center of the two blocks when compared to the chemistry at the surface locations of midpoint of the width, the corner, and the midpoint of the thickness of the two blocks, as shown in FIG. 6-9.

What is claimed is:

1. An article of a steel alloy produced in a high volume electric furnace comprising:

0.36% to 0.60% by weight carbon;
0.30% to 0.70% by weight manganese;
0.001% to 0.017% by weight phosphorus;
0.15% to 0.60% by weight silicon;
1.40% to 2.25% by weight nickel;
0.85% to 1.60% by weight chromium;
0.70% to 1.10% by weight molybdenum;
0.010% to 0.030% by weight aluminum;
0.001% to 0.050% by weight zirconium;
0.001% to 0.012% by weight phosphorus;
a maximum of 0.025% by weight sulfur;
a balance of iron; and
the article having a cross-sectional thickness of 20 inches or more, a transverse impact strength of 24 ft-lb, and a surface hardness range of 363-413 HBW.

2. The article of claim 1, further comprises 0.001% to 0.005% by weight phosphorus.

3. The article of claim 1, further comprising 0.02% to 0.10% by weight vanadium.

4. The article of claim 3, further comprising a maximum of 0.35% by weight copper.

5. The article of claim 4, further comprising a maximum of 0.020% by weight titanium.

6. An article having a cross-sectional thickness of 20 inches or more, fabricated from a steel alloy composition comprising:

0.36% to 0.46% by weight carbon;
0.30% to 0.50% by weight manganese;
0.001% to 0.012% by weight phosphorus;
0.15% to 0.30% by weight silicon;
1.75% to 2.25% by weight nickel;
1.40% to 1.60% by weight chromium;
0.90% to 1.10% by weight molybdenum;
0.015% to 0.025% by weight aluminum;
0.001% to 0.050% by weight zirconium;
a balance of iron; further comprising
a maximum of 0.003% by weight sulfur; and
the article having a surface hardness range of 363-413 HBW and a transverse impact strength of 24 ft-lb.

7. The article of claim 6, the steel alloy composition further comprising 0.02% to 0.07% by weight vanadium.

8. The article of claim 6, the steel alloy composition further comprising a maximum of 0.35% by weight copper.

9. The article of claim 6, the steel alloy composition further comprising a maximum of 0.020% by weight titanium.

10. An article having a cross-sectional thickness of 20 inches or less, comprising:

0.50% to 0.60% by weight carbon;
0.50% to 0.70% by weight manganese;
0.001% to 0.017% by weight phosphorus;
0.40% to 0.60% by weight silicon;
1.40% to 1.75% by weight nickel;
0.85% to 1.15% by weight chromium;
0.70% to 0.90% by weight molybdenum;
0.010% to 0.030% by weight aluminum;
0.001% to 0.050% by weight zirconium;
a balance of iron; and
the article having a surface hardness range of 363-413 HBW and a transverse impact strength of 24 ft-lb.

11. The article of claim 10, further comprising a maximum of 0.025% by weight sulfur.

12. The article of claim 11, further comprising 0.02% to 0.10% by weight vanadium.

13. The article of claim 12, further comprising a maximum of 0.35% by weight copper.

14. The article of claim 13, further comprising a maximum of 0.020% by weight titanium.

* * * * *